US005445595A

United States Patent [19]

Chou

[11] Patent Number: 5,445,595

[45] Date of Patent: Aug. 29, 1995

[54] MASSAGING MACHINE

[76] Inventor: Jen-Chung Chou, No. 141-1, Ho Ping Rd., Lu Chou Hsiang, Taipei Hsien, Taiwan

[21] Appl. No.: 220,694

[22] Filed: Mar. 30, 1994

[51] Int. Cl.[6] ..... A61H 15/00

[52] U.S. Cl. ..... 601/118; 601/102; 601/134; 601/116

[58] Field of Search ..... 601/51, 52, 97–99, 601/115, 116, 126, 127, 134, 84, 118, 102, 101

[56] References Cited

U.S. PATENT DOCUMENTS

| | | | |
|---|---|---|---|
| 3,374,784 | 3/1968 | Brent et al. | 601/133 |
| 4,373,516 | 2/1983 | Masuda et al. | 601/116 |
| 4,412,534 | 11/1983 | Hamabe et al. | 601/99 |
| 4,422,449 | 12/1983 | Hamabe | 601/99 |
| 4,491,127 | 1/1985 | Yamamura et al. | 601/116 |
| 4,574,786 | 3/1986 | Hashimoto et al. | 601/99 |
| 4,576,149 | 3/1986 | Otuka et al. | 601/99 |
| 5,233,973 | 8/1993 | Gill et al. | 601/99 X |

FOREIGN PATENT DOCUMENTS

| | | | |
|---|---|---|---|
| 405015560 | 1/1993 | Japan | 601/99 |
| 2123298 | 2/1984 | United Kingdom | 601/99 |

*Primary Examiner*—Robert A. Hafer
*Assistant Examiner*—Brian E. Hanlon
*Attorney, Agent, or Firm*—Bacon & Thomas

[57] ABSTRACT

A massaging machine includes a motor-driven hollow shaft including two ends each defining a slot. A shaft which includes a right-hand thread and a left-hand thread is insertable through the hollow shaft. A first distance-adjusting member includes a T-flange on an external surface and includes a right-hand thread on an internal surface for engaging with the right-hand thread on the shaft. A second distance-adjusting member includes a T-flange on an external surface and includes a left-hand thread on an internal surface for engaging with the left-hand thread on the shaft. Two cylinders each include an inclined face at an end and defines a T-slot in an internal surface for engaging with one of the T-flanges. Two sleeves are each insertable in one of the cylinders and are each mountable on one of the ends of the hollow shaft so that the T-flange of each sleeve is slidably received in one of the slots of the hollow shaft. Two wheels are each mounted by means of bearing on one of the sleeves. A plurality of elastic bosses are attached on each of the wheels.

1 Claim, 8 Drawing Sheets

MASSAGING MACHINE

BACKGROUND OF INVENTION

The present invention relates to a massaging machine which employs two massaging wheels which include an adjustable distance between each other for matching various size arms.

To the best knowledge of the present inventor, there are two prior art massaging machines which are deemed pertinent to the massaging machine in accordance with the present invention.

The first prior art massaging machine uses two massaging rods which are rocked so that the free ends of the massaging rods are periodically moved towards each other in order to massage a user's arm which is disposed between the free ends of the massaging rods. The first prior art massaging machine includes a drawback that the positions of the massaging rods cannot be adjusted. The shortest distance between the free ends of the massaging rods might be much smaller than the width of a user's arm so that the user's arm might be hurt.

The second prior art massaging machine uses a plurality of massaging rollers which are mounted on each of two wheels which are mounted on a hollow shaft which is driven by means of a motor which is received in the hollow shaft. An arm can be massaged by means of the rollers. The second prior art massaging machine includes a drawback that when the motor is broken, the wheels and the hollow shaft must be. dismantled so that the motor can be repaired which is inconvenient.

Therefore, there is a long and unfulfilled need for a massaging machine which is safe to use and easy to maintain.

SUMMARY OF INVENTION

It is the primary object of the present invention to provide a massaging machine which is safe to use and easy to maintain.

The primary object of the present invention is achieved by providing a massaging machine which includes a motor-driven hollow shaft including two ends each defining a slot. A shaft which includes a right-hand thread and a left-hand thread is insertable through the hollow shaft. A first distance-adjusting member includes a T-flange on an external surface and includes a right-hand thread on an internal surface for engaging with the right-hand thread which is formed on the shaft. A second distance-adjusting member includes a T-flange on an external surface and includes a left-hand thread on an internal surface for engaging with the left-hand thread which is formed on the shaft. Two cylinders each include at an end an inclined face and defines in an internal surface a T-slot for engaging with one of the T-flanges. Two sleeves are each insertable in one of the cylinders and are each mountable on one of the ends of the hollow shaft so that the T-flange of each sleeve is slidably received in one of the slot of the hollow shaft. Two wheels are each mounted by means of bearing on one of the sleeves. A plurality of elastic bosses are attached on each of the wheels.

For a better understanding of the present invention and objects thereof, a study of the detailed description of the embodiments described hereinafter should be made in relation to the accompanying drawings.

DETAILED DESCRIPTION OF PREFERRED EMBODIMENT

Before the massaging machine of the present invention is described in detail, two prior art massaging machines are described in order to show the advantages of the present invention over prior art.

Figure 8:
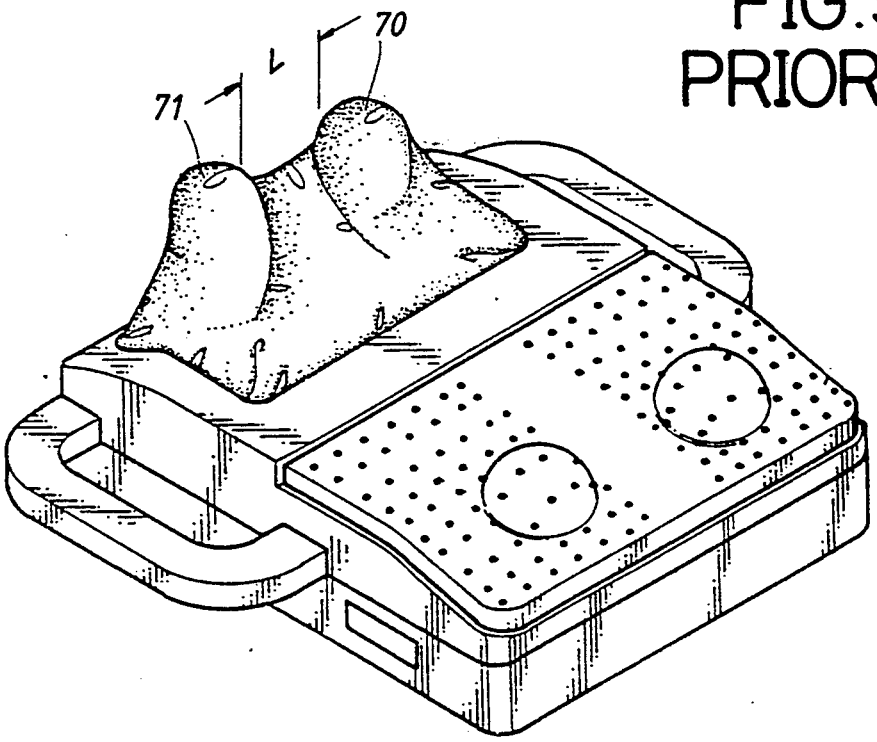
FIG.8 PRIOR ART
FIG. 8 is an isometric view of a first massaging machine in accordance with prior art.

Referring to FIG. 8, in accordance with prior art, the first massaging machine uses two massaging rods 70 and 71 which are rocked so that the free ends of the massaging rods 70 and 71 are periodically moved towards each other in order to massage a user's arm which is disposed between the free ends of the massaging rods 70 and 71. The first prior art massaging machine includes a drawback that the positions of the massaging rods 70 and 71 cannot be adjusted. The shortest distance between the free ends of the massaging rods 70 and 71 might be much smaller than the width of a user's arm so that the user's arm might be hurt.

Figure 9:
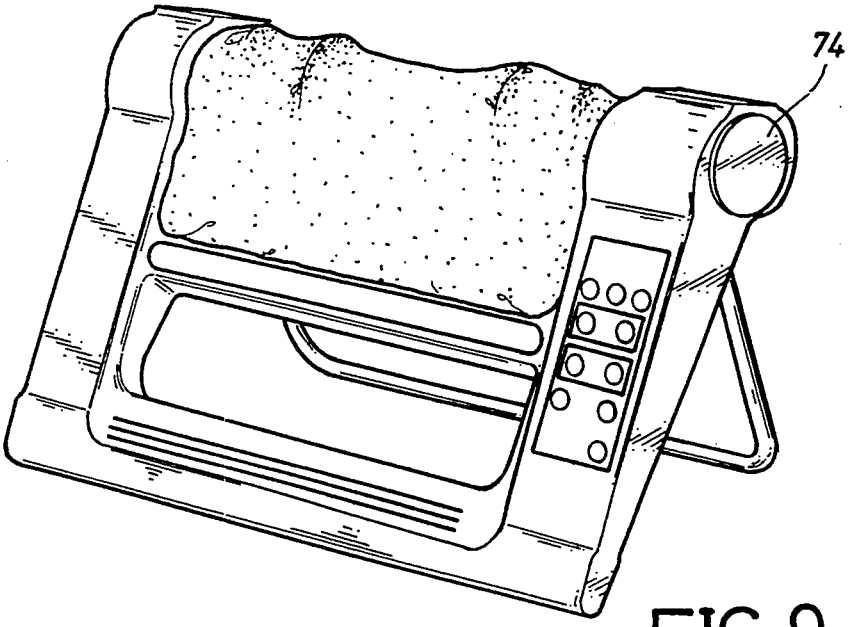
FIG.9 PRIOR ART
FIG. 9 is an isometric view of a second massaging machine in accordance with prior art.

Referring to FIG. 9, the second massaging machine in accordance with prior art uses a plurality of rollers which are mounted on two wheels which are mounted on a hollow shaft 74 which is driven by means of a motor which is received in the hollow shaft 74. An arm can be massaged by means of the rollers. The second massaging machine includes a drawback that a user must dismantle the wheels and the hollow shaft in order to repair the motor when the motor is broken, this is inconvenient.

Figure 1:
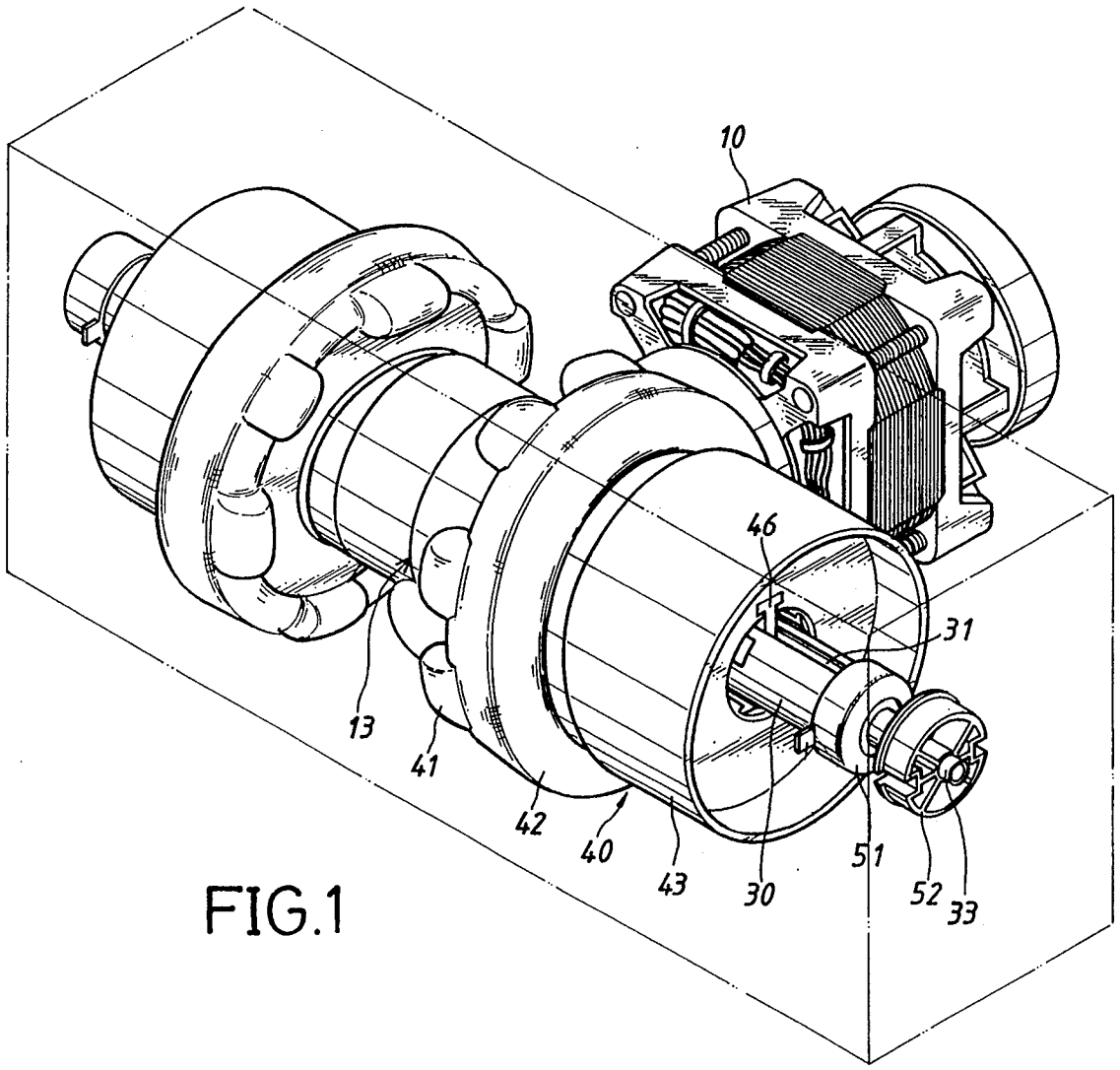
FIG. 1 is an isometric view of a massaging machine in accordance with the preferred embodiment of the present invention.
Figure 2:
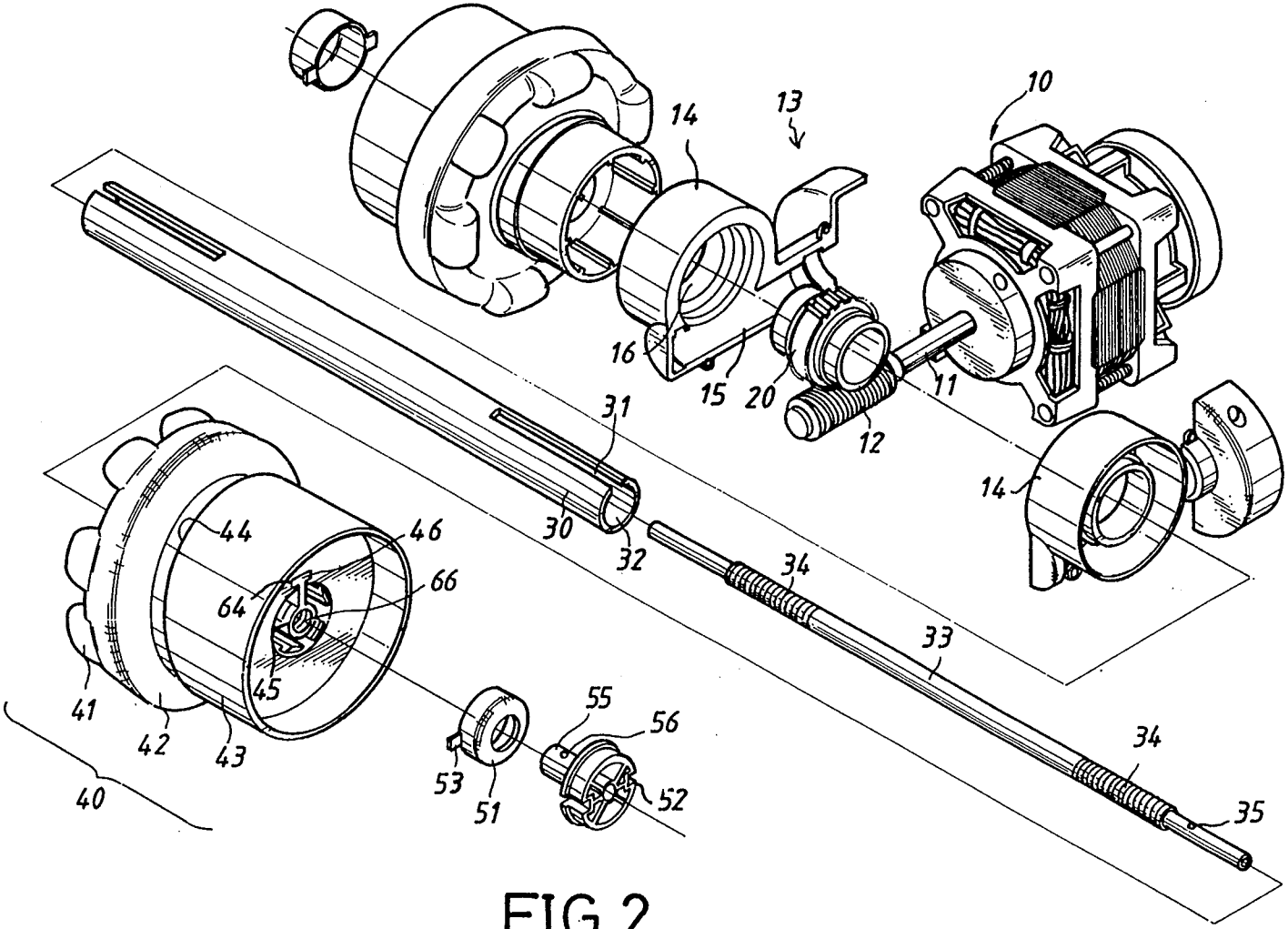
FIG. 2 is an exploded view of the massaging machine shown in FIG. 1.

Referring to FIGS. 1 and 2, in accordance with the preferred embodiment of the present invention, a massaging machine uses a motor 10. A mandrel 11 extends from the motor 10. A worm 12 is attached to the mandrel 11. A worm gear 20 is engageable with the worm 12. The worm gear 20 is mounted on a hollow shaft 30 which defines at two ends two slots 31 which will be described later. The engagement of the worm 12 with the worm gear 20 is essential to transform the rotation of the mandrel 11 into the rotation of the hollow shaft 30, as the mandrel 11 is perpendicular to the hollow shaft 30.

A gear box 13 consists of two halves 14. Each half 14 defines a recess 15. Each half 14 further defines a recess 16. In assembly, the halves 14 are joined together by means of a plurality of screws (not shown) so as to form the gear box 13. The worm 12 is received in a space which is defined by the recesses 15. The worm gear 20 is received in a space which is defined by the recesses 16. The gear box 13 is attached to the motor 10 by means of a plurality of threaded bolts (not shown). The gear box 13 is secured in a housing (shown in phantom lines in FIG. 1). The hollow shift 30 is supported by means of the gear box 13 which is supported by means of the housing. Further elements which will be described later are indirectly supported by means of the gear box 13. That is, all of the components of the massaging machine are supported by means of the housing.

Figure 3:
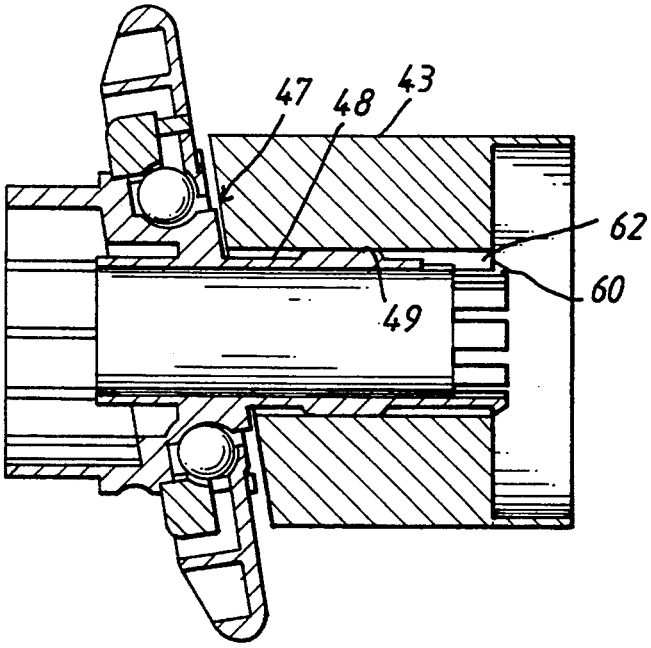
FIG. 3 is a cross-sectional view of a massaging unit of the massaging machine shown in FIG. 1.

Two threads 34 are each formed near one of two ends of a shaft 33. One thread 34 is a right-hand thread, and the remaining thread 34 is a left-hand thread. A depression 35 is defined near one end of the shaft 33. The shaft 33 is axially inserted through the hollow shaft 30. The depression 35 is disposed beyond the hollow shaft Referring to FIGS. 3 and 2, a plurality of elastic bosses 41 are attached on one of two sides of each of two wheels 42. Each wheel 42 is mounted by means of a bearing 47 on a sleeve 48 in such a way that the axis of the wheel 42 does not coincide with the axis of the sleeve 48.

A plurality of ribs 49 are formed on an external surface of each sleeve 48. A plurality of spaced hooks 60 longitudinally project from the sleeve 48.

Two cylinders 43 each include an inclined face at a first end. Each cylinder 43 includes an internal surface which defines several slots 62 and a T-slot 64.

Each cylinder 43 is mounted on one of the sleeves 48 in a way that the slots 62 engage with the ribs 49, so that the cylinder 43 and the sleeve 48 rotate simultaneously. Each cylinder 43 is retained on one of the sleeves 48 as a second end of the former is hooked by the hooks 60 of the latter.

Two distance-adjusting members 45 each include an external surface on which a T-flange 46 is formed and an internal surface on which a thread 66 is formed. The thread 66 of one distance-adjusting member 45 is a right-hand thread, and the thread 66 of the remaining distance-adjusting member 45 is a left-hand thread. Each distance-adjusting member 45 is received in one of the sleeves 48 in a way that the T-flange 46 extends between two of the hooks 60 and engages with the T-slot 64.

Figure 4:
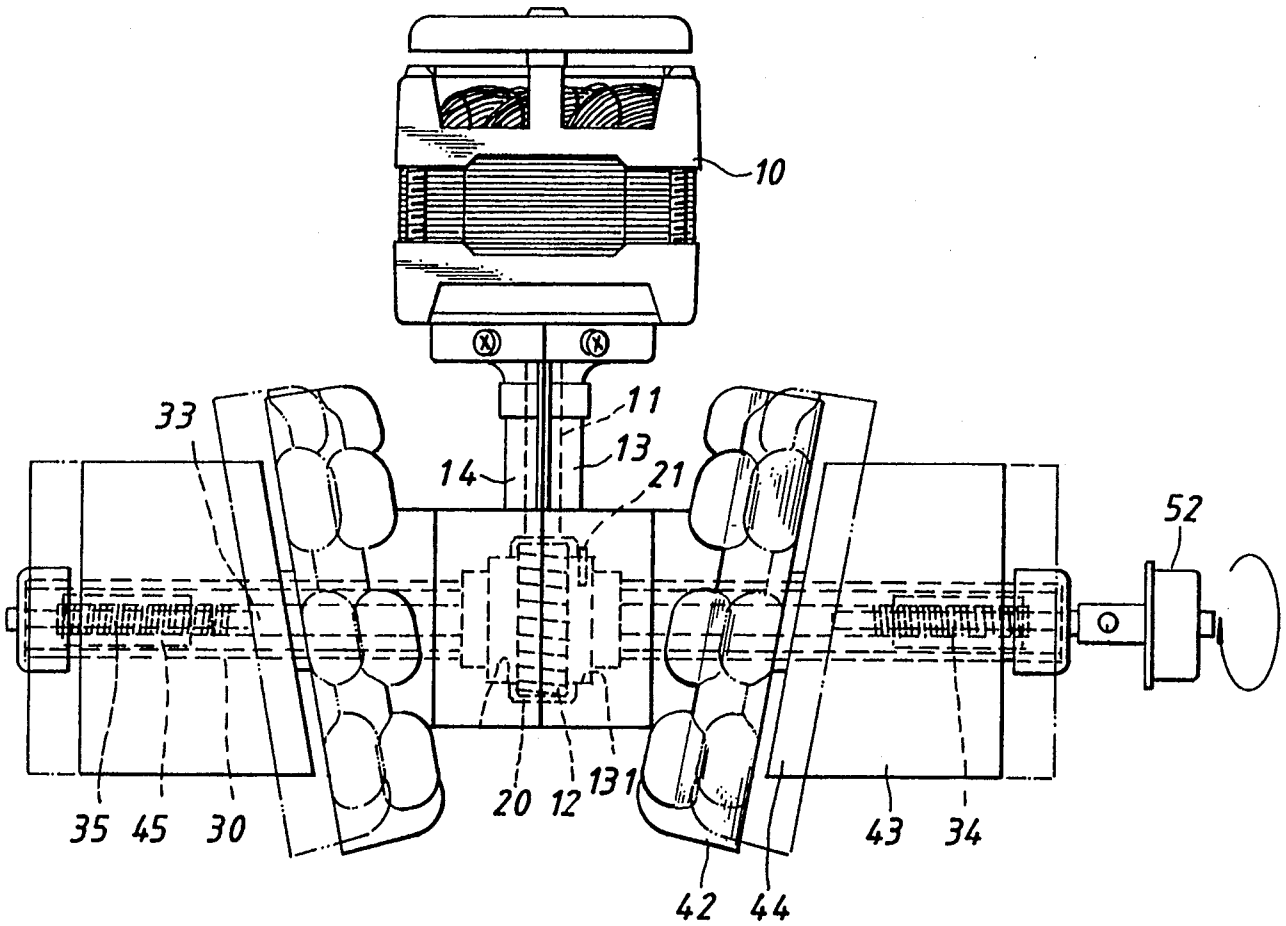
FIG. 4 is a top view of the massaging machine shown in FIG. 1, showing in bold lines two massaging wheels in a first position, and showing in phantom lines the massaging wheels in a second position.

The sleeves 48 are mounted on the hollow shaft 30. The distance-adjusting members 45 are received in the hollow shaft 30. Each T-flange 46 is received in one of the slots 31. Thus, the hollow shaft 30, the distance-adjusting members 45, the sleeves 48 and the cylinders 43 rotate simultaneously. At this instant, the bolt shaft 33 is inserted through the distance-adjusting members 45. Each thread 34 engages with one of the threads 66. By rotating the shaft 33 relative to the hollow shaft 30, the positions of the distance-adjusting members 45, the sleeves 48 and the cylinders 43 are moved, i.e., the distance between the wheels 42 is changed (see FIG. 4).

Figure 5:
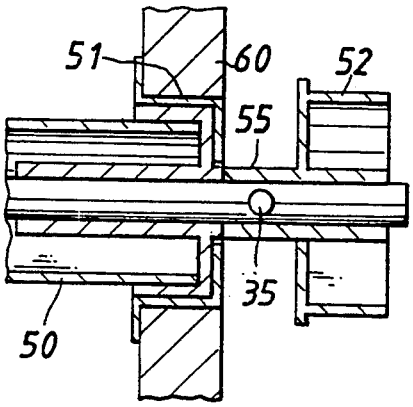
FIG. 5 is a cross-sectional view of a shaft and a knob of the massaging machine shown in FIG. 1.

Referring to FIGS. 2 and 5, two caps 51 each defines an aperture 54. Each cap 51 includes a tab 53 which radially projects therefrom. The caps 51 are respectively mounted on the ends of the hollow shaft 30. Each end of the shaft 33 is inserted through the aperture 54 in one of the caps 51.

A knob 52 includes a hub 55 axially projecting therefrom. The hub 55 of the knob 52 defines an aperture 56. One of the ends of the shaft 33 is received in the hub 55 of the knob 52. A pin (not shown) is inserted through the aperture 56 and is received in the depression 35 so as to retain the knob 52 on the shaft 33. Thus, a user can rotate the shaft 33 easily by way of rotating the knob 52.

Figure 6:
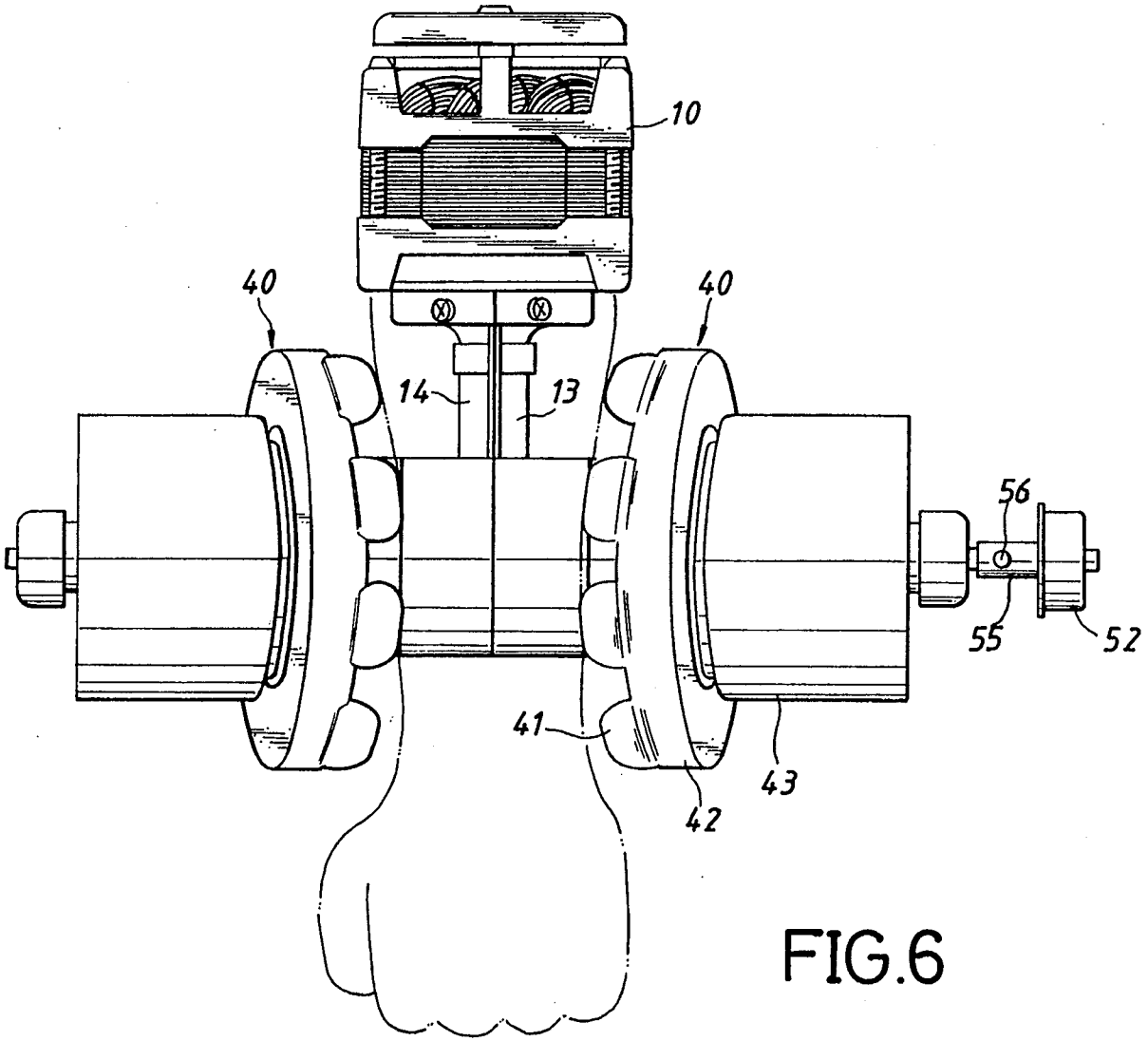
FIG. 6 is a top view of the massaging machine shown in FIG. 1, showing an arm compressed between two wheels.

Referring to FIG. 6, an arm is disposed between the wheels 42. The inclined faces of the cylinders 43 act as cam surfaces so as to periodically push the wheels 42 towards each other. Thus, the arm is massaged by means of the massaging bosses 41.

Figure 7:
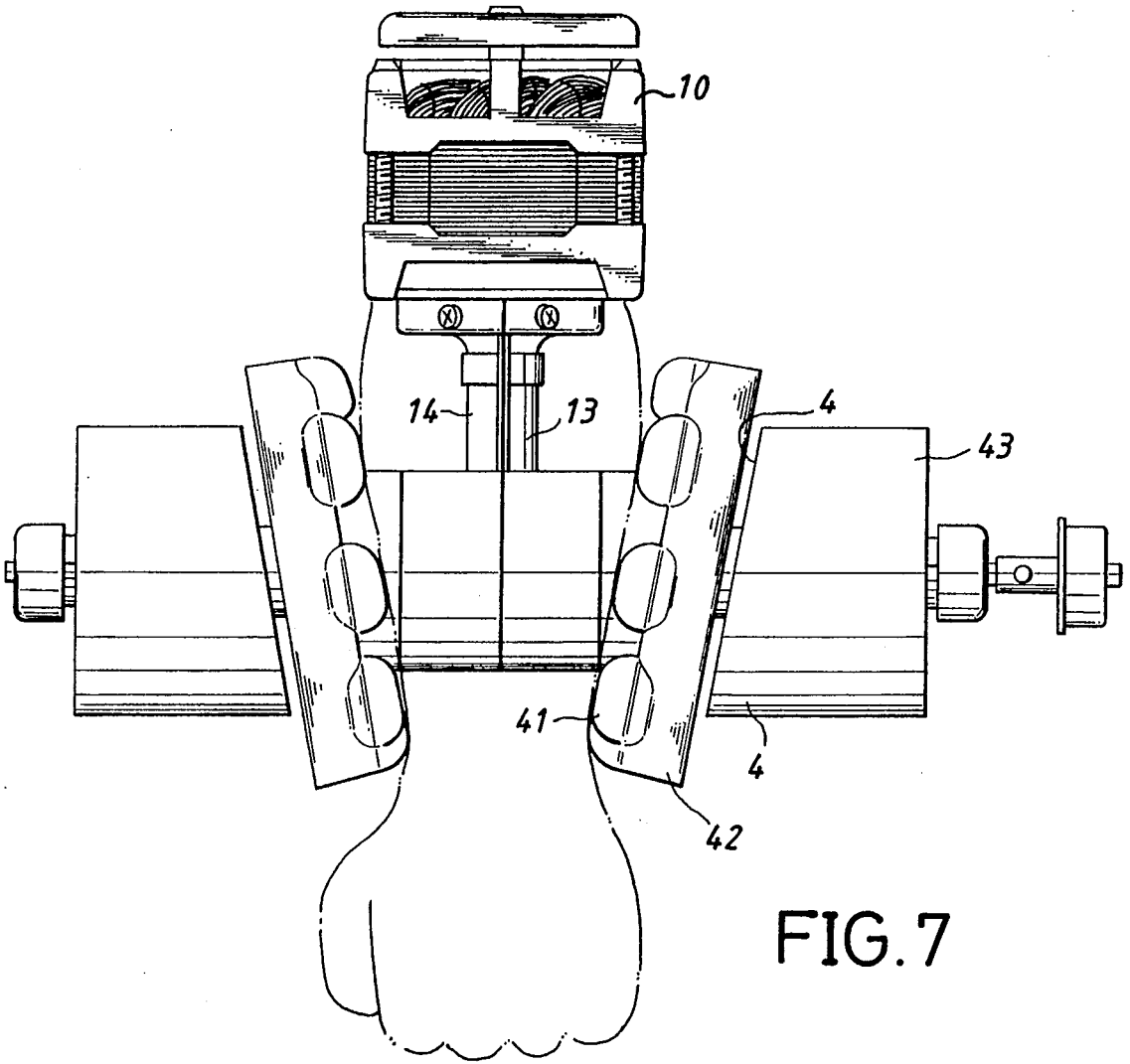
FIG. 7 is a similar view to FIG. 6, but showing the wheels compressing a larger arm.

Referring to FIG. 7, by rotating the knob 52, the distance between the wheels 41 is enlarged. Thus, a larger arm can be disposed between the wheels 42.

A first advantage of the present invention over prior art is that it fits different users as the distance between the wheels 42 is adjustable. A second advantage of the present invention over prior art is that the motor 10 is easily accessible for maintenance as the motor 10 is arranged outside the hollow shaft 30.

While the present invention includes been explained in relation to its preferred embodiment, it is to be understood that variations thereof will be apparent to those skilled in the art upon reading this specification. Therefore, the present invention is intended to cover all such variations as shall fall within the scope of the appended claims.

What is claimed is:

1. A massaging machine comprising:

a motor-driven hollow shaft having two opposite ends each defining a slot;

a shaft being located within the hollow shaft and having a right-hand thread portion and a left-hand thread portion;

a first distance-adjusting member having an external surface on which a T-flange is formed and an internal surface on which a right-hand thread is formed engaging the right-hand thread portion on the shaft, the T-flange thereof slidably received in the slot defined in one of the opposite ends of the hollow shaft;

a second distance-adjusting member having an external surface on which a T-flange is formed and an internal surface on which a left-hand thread is formed engaging the left-hand thread portion on the shaft, the T-flange thereof slidably received in the slot defined in the remaining one of the opposite ends of the hollow shaft;

two cylinders slidably mounted on the hollow shaft, each having an end with an inclined face and a T-slot formed in an internal surface engaging a corresponding one of the T-flanges;

two sleeves each secured in a corresponding one of the cylinders and mounted on a corresponding one of the opposite ends of the hollow shaft;

two wheels each mounted on a corresponding one of the two sleeves in an inclined manner by means of a bearing and each comprising a first surface and a second surface, the first surface of each of the wheels used for engagement with the inclined surface of each of the cylinders for axial movement of the wheels; and a plurality of elastic bosses attached to the second surface of each of the wheels so that the elastic bosses attached to one of the wheels face the elastic bosses attached to the remaining one of the wheels.

* * * * *